US005306376A

United States Patent [19]

James

[11] Patent Number: 5,306,376

[45] Date of Patent: Apr. 26, 1994

[54] SEALING TAPE FOR SCREEN PRINTING

[76] Inventor: Martin F. James, 411 Coventry Way, Noblesville, Ind. 46060

[21] Appl. No.: 27,786

[22] Filed: Mar. 8, 1993

[51] Int. Cl.[5] ..... B05C 17/08

[52] U.S. Cl. ..... 156/291; 101/128.1; 101/129; 428/195; 428/343; 156/290

[58] Field of Search ..... 156/291, 290, 277; 101/126, 127.1, 129, 474, 128.1, 128.21; 428/141, 194, 195, 343

[56] References Cited

U.S. PATENT DOCUMENTS

| | | | |
|---|---|---|---|
| 3,125,460 | 3/1964 | Rose | 428/343 |
| 4,023,488 | 5/1977 | Zimmer | 101/127.1 |
| 4,129,076 | 12/1978 | Gardner | 101/127.1 |
| 4,341,828 | 7/1982 | Stephens | 428/343 |
| 4,702,783 | 10/1987 | Mason | 156/307.3 |
| 4,860,467 | 8/1989 | Larson | 101/127.1 |
| 5,051,259 | 9/1991 | Olsen | 428/343 |
| 5,098,786 | 3/1992 | Hanke | 428/194 |

*Primary Examiner*—Michael W. Ball
*Assistant Examiner*—Daniel J. Stemmer
*Attorney, Agent, or Firm*—Woodard, Emhardt, Naughton, Moriarty & McNett

[57] ABSTRACT

A screen printing sealing tape with two patterns of adhesive adhered in parallel to a substrate's surface. The first pattern is a continuous strip of adhesive. The second pattern is comprised of discrete segments of adhesive spaced longitudinally of the substrate spaced by colored non-tacky areas.

5 Claims, 3 Drawing Sheets

SEALING TAPE FOR SCREEN PRINTING

BACKGROUND OF THE INVENTION

This invention relates generally to screen printing and, more particularly, to an adhesive tape used to seal printing screen from ink penetration.

Silk-screen printing, more accurately designated "screen printing", has long been used to produce high quality illustrations although its method does not readily lend itself to high volume production. In the last decade, however, screen printing has had a resurgence in use for applications where long runs of high quality prints are desired, this resurgence being due to the use and the process of more complex, automatic equipment.

Screen printing is a form of stencil printing using a design fashioned from an emulsion or other material attached to a woven sheet of fabric (silk, organdy, nylon or polyester fibers, copper, stainless steel strands, etc.) which has been tightly stretched across a frame. Ink is then forced through the open meshes of the fabric sheets by means of a rubber blade or squeegee. The size of the opening in the mesh of the woven fabric, if formed of silk might vary from 6XX (coarse) to 18XX (very fine). The mesh can also be achieved by etching a thin metal plate but more commonly is formed by a woven fabric.

Pervading all screen printing applications, particularly where a flexible fabric is used, is the requirement that certain screen area, generally that residing from a stencil's outside edge to the screen's frame, be sealed from ink penetration. This seal is needed to prevent ink from leaking around the stencil's outside edge to bleed onto the object being printed. Typically, adhesive tape is used as a sealant.

A split tape, popularly used today, has a release liner covering the tape's adhesive side. The liner is scored lengthwise down the tape's approximate center. Aided by the scoring, an operator peels one-half of the release liner away from the tape's adhesive and leaves the other half of release liner in place. The operator then places the half with exposed adhesive directly onto the screen and allows the half still covered by the release liner to simply rest against the sides of the screen-printing frame.

There are problems with this tape and its associated split liner. Excessive ink can flow behind the tape, between the tape and the frame, because this half of the split tape is not adhered to the frame. Such may allow ink to flow through the screen to ultimately bleed over the printed image underneath. Or possibly worse, this half of split tape may fall inward and onto the screen which may allow even more bleeding.

Additional problems relate to the use of a liner. The operator must peel away this liner before applying the tape. This added step slows down production and creates additional waste. And occasionally, the process of scoring the release liner damages the tape. If scored too deep, the tape is cut and any seal the tape might form is breached. Because of these problems and the respective higher cost of this tape, conventional tapes such as mastic tape or duct tape have been tried as well.

As most frames are made of aluminium, adhesives tend to grab aggressively to the frame and leave behind adhesive residue when the tape is removed. If masking tape is used, it generally will not pull off in one piece but will tear into many small strips. The additional labor cost to pick off the many small pieces makes it an expensive process. Additionally, adhesive residue is left behind on the frame and screen. If duct tape is used, the strips usually come off in one piece, but much adhesive is left behind upon the frame and screen. The operator must either leave the adhesive on the expensive frame for further build up, or use solvents to scrub the frame clean, a very labor intensive and expensive process.

With these thoughts in mind, an improved sealing tape for screen printing is needed which combines the production efficiency of linerless tape without the problems created by adhesive residue upon its removal. Preferably, the tape would be cheaper than existing release liner tapes and leave little to no adhesive behind after its use.

SUMMARY OF THE INVENTION

One embodiment of the invention might involve a tape for use in screen printing comprising a substrate coated with two adhesive patterns residing in parallel throughout the length of the substrate. The first pattern includes a continuous strip of adhesive and the second pattern includes discrete segments of adhesive spaced longitudinally of the substrate. In a preferred embodiment, the two patterns are contiguous with each other and encompass the entire width of the tape substrate. In another preferred embodiment, the adhesive segments are spaced by non-tacky areas of a different color than the adhesive segments.

Also encompassed by the present invention is a method for using the aforementioned tape wherein the tape is adhered to a frame to block the passage of ink between the frame and the screen pattern. The tape has a first pattern of adhesive which is a continuous strip and a second pattern with longitudinally spaced discrete patterns of adhesive. The second pattern is adhered to the frame and the first is adhered to the screen inboard of the frame.

An object of the present invention is to provide an improved sealing tape suitable for screen printing which prevents excessive adhesive from remaining on the screen and frame after the tape's use without the need for an adhesive liner.

BRIEF DESCRIPTION OF THE DRAWINGS

In the accompanying drawings, forming a part of this specification, and in which like numerals are employed to designate like parts throughout the same.

DESCRIPTION OF THE PREFERRED EMBODIMENT

Figure 1:
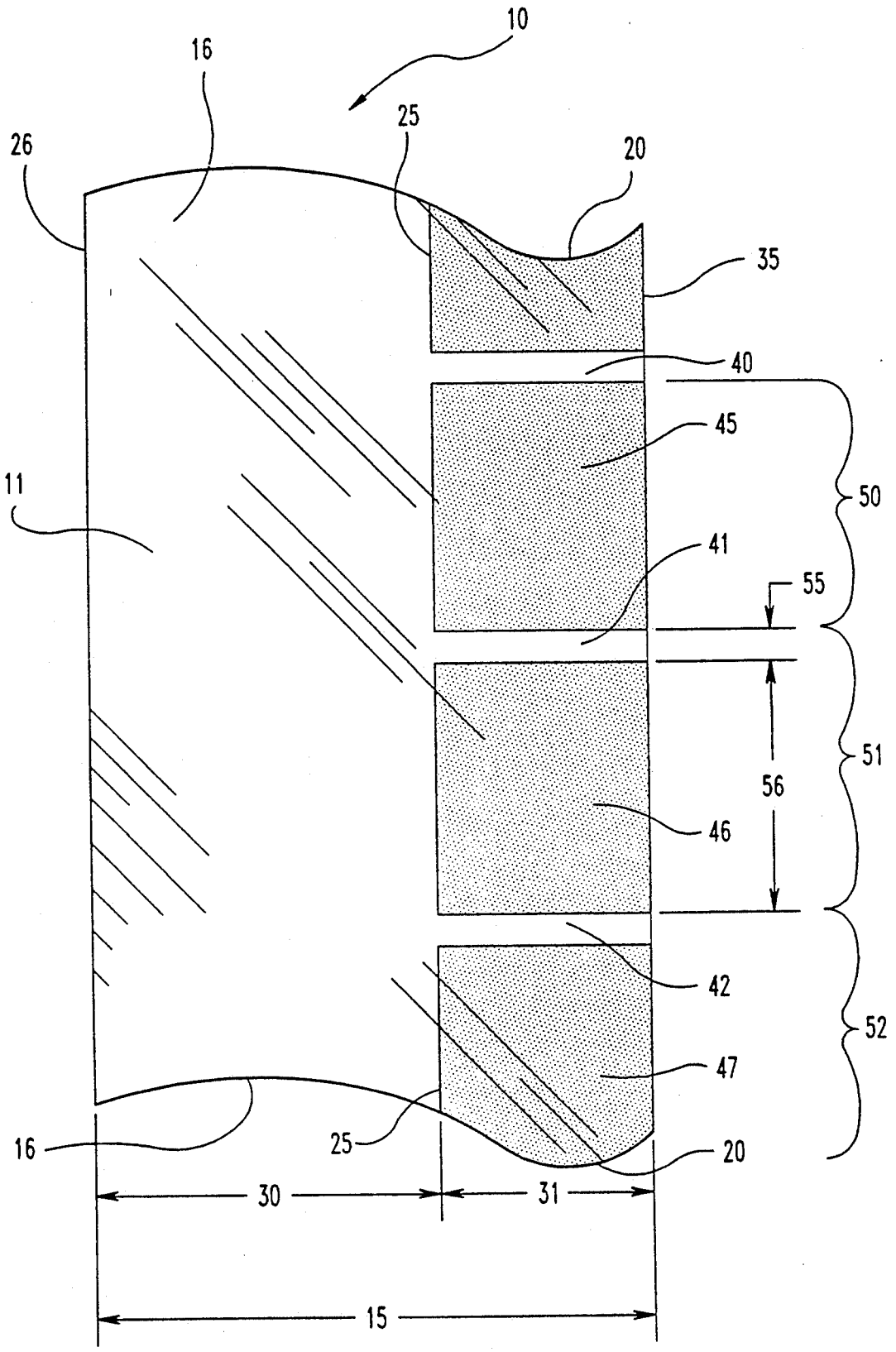
FIG. 1 is a plan view of a piece of the sealing tape.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates Referring to FIG. 1, there is shown a representative piece of the sealing tape 10 for screen printing in accordance with one embodiment of the present invention. The tape itself is generally stored on a roll and contains a repetitive structure such that a detailed description of a single piece is representative of an entire length of sealing tape. Therefore, tape 10 includes a substrate 11 having a width 15. Preferably, substrate 11 is comprised of plastic but other substrate materials, those commonly associated with adhesive tape, may be suitable as well. Adhered to a common face of substrate 11 are a first lengthwise adhesive pattern 16 and a second lengthwise adhesive pattern 20. Patterns 16 and 20 are positioned parallel to each other over the length of substrate 11. Additionally, it is preferable that these patterns are contiguous and in FIG. 1 make contact along boundary 25.

Pattern 16, depicted to the left of boundary 25 in FIG. 1, is comprised of a continuous strip of adhesive positioned to one side of an intermediate line along the length of the substrate 11 (here, boundary 25). Preferably, first lengthwise adhesive pattern 16 has a width 30 distally extending from boundary 25 to a distal edge 26 of substrate 11. Maintaining this preferable width throughout the length of the substrate 11 offers the most preferable embodiment of pattern 16.

Pattern 20, shown to the right of boundary 25 in FIG. 1, is comprised of discrete segments of adhesive spaced longitudinally along the length of substrate 11. Pattern 20 is positioned on the same face of substrate 11 as pattern 16; however, it is located to the opposite side of the aforementioned intermediate line. Preferably, second lengthwise adhesive pattern 20 has a width 31 distally extending from boundary 25 to a distal edge 35 of substrate 11.

The discrete segments of adhesive comprising pattern 20 include discrete segments of adhesive such as 40, 41 and 42 spaced by non-tacky areas such as 45, 46 and 47. The discrete adhesive segments should preferably extend from boundary 25 to distal edge 35. The non-tacky areas are generally free from adhesive, but are preferably formed by deactivating adhesive previously residing in these areas. The preferable means to deactivate the adhesive comprises coating these areas with a varnish or similar compound that renders the areas tacky. Furthermore, it is preferable that the adhesive-free areas have a different color than the discrete adhesive segments to visually distinguish the two. This can be accomplished by coloring the varnish or similar compound used to deactivate the adhesive. And still further, it preferable that the non-tacky areas (i.e. 45 and 46) and the discrete adhesive segments (i.e. 40, 41 and 42), both have rectangular shape.

In one embodiment of the invention the dimension 15 is 4 inches, the dimension 30 is 2-½ inches, dimension 31 is 1-½ inches, dimension 56 is 1-⅞ inches, and dimension 55 is ⅛ inch. Also in this embodiment of the invention, the lengthwise dimension 55 of an adhesive segment is approximately ⅛ of the lengthwise dimension 56 of an adhesive free area. Alternatively, in an another embodiment, this relationship is ⅓. The difference residing in how much adhesive is desired to be exposed to the silk screening frame by the user.

The adhesives used to form both of the above-mentioned patterns is not critical. Any adhesive suitable to contact the screen and screen frame and still adhere to the substrate is appropriate.

Figure 2:
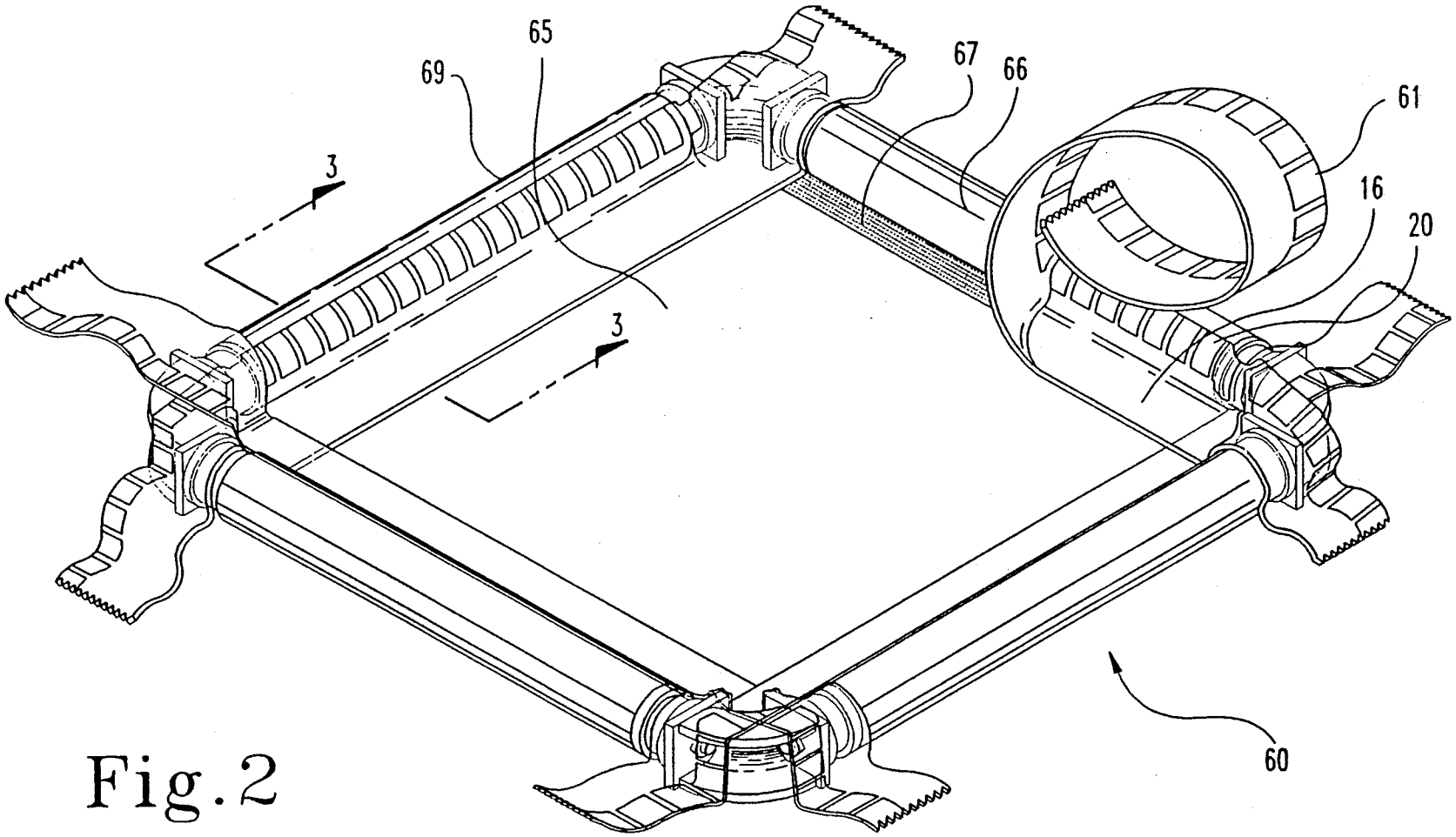
FIG. 2 is a perspective view of the sealing tape in use, and, FIG. 3 is a cross-sectional view of the sealing tape in use.

Referring now to FIG. 2, a roller screen printing frame 60 is shown with sealing tape 61 thereto being applied in accordance with one embodiment of the present invention. Residing between stencil 65 and frame side 66 is an area of screen-printing fabric 67 with open meshes. It is mesh area 67 which must be covered to prevent ink from bleeding around the edges of stencil 65. Sealing tape 61 is applied with continuous adhesive pattern 16 contacting and covering mesh area 67. Preferably, tape 61 slightly overlaps stencil 65 in aid to prevent ink from leaking underneath adhesive pattern 16. Sealing tape 61 is further applied with the discrete segments of adhesive in adhesive pattern 20 lightly tacked against frame side 66. (Note that the pattern 20 and 16 are shown in solid lines in FIG. 2 because the substrate 11 is transparent in the particular embodiment illustrated.) When tape 61 is applied in the aforesaid manner, tape 61 forms a dam to contain ink within the frame and over stencil 65. This dam prevents ink from leaking through to open mesh area 67.

Figure 3:
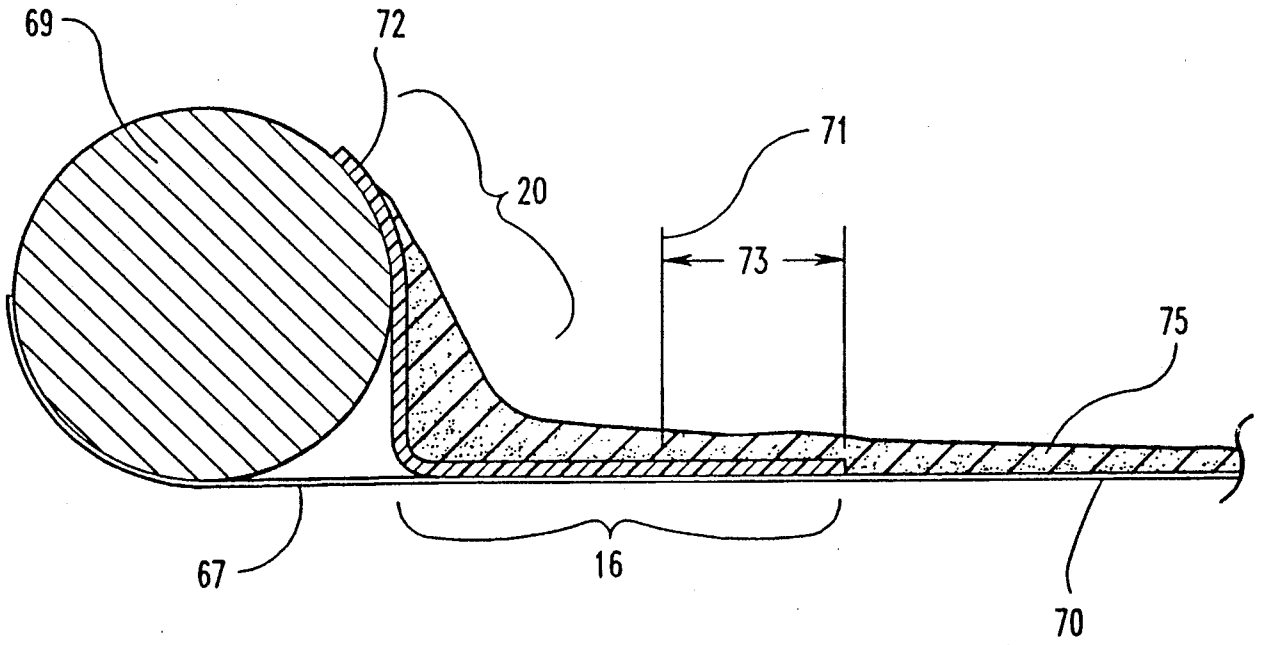

Referring now to FIG. 3, a cross section 3—3 of this dam is shown as created by the sealing tape. Woven material 70 is pulled or stretched around frame side 69 and supports stencil 65 (FIG. 2). Adhesive pattern 16 of sealing tape 72 adheres to woven material 70 and slightly overlaps stencil 65 (FIG. 2) from the stencil's distal edge 71 a distance 73. Segmented adhesive pattern 20 contacts frame side 69 thusly sealing open mesh area 67 from ink overflowing the stencil. The perpendicular rise of pattern 20 in respect to woven material 70 creates the dam that retains ink 75. Thus, ink 75 cannot readily reach open mesh area 67 when excess ink spreads past a stencil's distal edges. And furthermore, tacky segments (i.e. 40, 41, 42 in FIG. 1) slightly adhere to frame 69 and prevent sealing tape 72 from falling back onto woven material 70.

After use, the tape generally peals off quickly and cleanly in one piece. Due to the narrow adhesive segments of pattern 20, little to no adhesive is left on frame 69 after the removal of tape 72.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a method for stencil printing with a design, fashioned with an emulsion or other material, attached to a woven sheet of fabric stretched across a roller frame, including the step of sealing the peripheral area of said woven sheet residing between the distal edges of said emulsion or other material and the rollers of said roller frame with tape; the improvement which comprises sealing with tape without the removal of a release liner to expose adhesive residing upon said tape, said tape including a substrate, adhesive received on said substrate in a first lengthwise adhesive pattern and a second lengthwise adhesive pattern, said first pattern being parallel to said second pattern, said first pattern including a continuous strip of adhesive, said second pattern including discrete segments of adhesive spaced longitudinally of the substrate, and causing said second pattern to contact said roller frame.

2. A method for stencil printing comprising the steps of:

(a) stretching a woven sheet of fabric across a frame, said woven sheet having a peripheral area;

(b) securing the peripheral area of the fabric to the frame;

(c) attaching a stencil design to said woven sheet inboard of said peripheral area;

(d) sealing the peripheral area of said woven sheet and the frame with tape, said tape including a substrate, adhesive received on said substrate in a first lengthwise adhesive pattern and a second lengthwise adhesive pattern, said first pattern being parallel to said second pattern, said first pattern including a continuous strip of adhesive, said second pattern including discrete segments of adhesive spaced longitudinally of the substrate, said sealing accomplished by adhering said second pattern to said frame and said first pattern to said fabric inboard of said second pattern.

3. The method of claim 2 performed without the step of removing a release liner to expose adhesive residing upon said tape.

4. The method of claim 2 wherein said substrate has plain adhesive-free areas spacing said segments of adhesive, said adhesive-free areas being of a different color than said adhesive segments.

5. The method of claim 4 wherein the lengthwise dimension of said adhesive segments longitudinally of said substrate is approximately one-eighth of the dimension of said adhesive free areas.

* * * * *